United States Patent [19]

Myers et al.

[11] 4,211,437

[45] Jul. 8, 1980

[54] STILT CAPSULES FOR PRESSURE-SENSITIVE RECORD MATERIAL

[75] Inventors: Hugh K Myers; Donald E. Hayford, both of Appleton, Wis.

[73] Assignee: Appleton Papers Inc., Appleton, Wis.

[21] Appl. No.: 899,847

[22] Filed: Apr. 25, 1978

[51] Int. Cl.[2] ..... B41M 5/16; B41M 5/22

[52] U.S. Cl. ..... 282/27.5; 252/316; 427/150; 427/151; 428/216; 428/307; 428/308; 428/327; 428/331; 428/402; 428/403; 428/404; 428/407; 428/537; 428/914

[58] Field of Search ..... 106/21; 252/316; 282/27.5; 427/150, 151, 152; 428/307, 402, 411, 537, 913, 914, 308, 323, 327, 331, 403, 404, 407, 216

[56] References Cited

U.S. PATENT DOCUMENTS

| | | | |
|---|---|---|---|
| 3,179,600 | 4/1965 | Brockett | 428/307 X |
| 3,617,334 | 11/1971 | Brockett et al. | 428/206 |
| 3,697,323 | 10/1972 | Brown et al. | 428/307 X |
| 3,996,405 | 12/1976 | Porter | 428/307 |
| 4,038,445 | 7/1977 | Robertson | 427/150 |

*Primary Examiner*—Bruce H. Hess

*Attorney, Agent, or Firm*—Birch, Stewart, Kolasch and Birch

[57] ABSTRACT

This invention relates to paper, or like sheet material, having a coating comprising minute, liquid-containing, pressure-rupturable capsules, and also larger, non-rupturable kaolin-containing stilt capsules arranged in interspersion and in close juxtaposition. In the preferred embodiment the smaller capsules contain a liquid marking agent. The capsules, large and small, are interspersed as to size, and are closely spaced on the sheet, so that an intentional impact directed on a small area of the coating will crush substantially all of the small capsules in the area and result in the release of liquid marking agent, whereas a casually applied pressure will rupture relatively few of the small capsules in the area. The marking liquid may be a colorless chromogenic color reactant. The small capsules on a sheet containing said marking liquid may be associated with other color forming materials on said sheet, or alternatively said color forming materials may be contained on another contacting sheet.

19 Claims, 2 Drawing Figures

STILT CAPSULES FOR PRESSURE-SENSITIVE RECORD MATERIAL

BACKGROUND OF THE INVENTION

1. Field of Invention

This invention relates to pressure sensitive copy sheets which are coated on at least one face with pressure-rupturable units containing a marking liquid, and interspersed and in close juxtaposition therewith larger, non-rupturable units containing kaolin particles, for the purpose of protecting the pressure-rupturable units from accidental impacts and premature color formation.

2. DESCRIPTION OF THE PRIOR ART

U.S. Pat. No. 3,481,759 to Ostlie, issued Dec. 2, 1969, teaches the use of discrete stilt particles which consist of the same material as is employed to encapsulate the liquid marking material. Stated otherwise, the stilt particles are composed primarily of solid encapsulating material, i.e., they contain only a small amount of the liquid.

U.S. Pat. No. 3,617,334 to Brockett et al, issued Nov. 2, 1971, teaches the use of discrete stilt particles which consist of encapsulating material having a liquid fill. That is, each of the stilt particles consists of encapsulating material containing a plurality of inert liquid droplets.

U.S. Pat. No. 3,697,323 to Brown, Jr. et al, issued Oct. 10, 1972, does not teach the use of discrete stilt particles. It is, however, considered to be of interest because it teaches, particularly in FIG. 5A, the use of a continuous binder material layer containing encapsulated liquid droplets of the marking agent, and also solid filler material bits and free spaces (voids). Kaolin is not mentined for use as the solid filler material bits; only bentonite clay is mentioned, among other substances, for such use.

U.S. Pat. No. 2,655,453 to Sandberg, issued Oct. 13, 1953, teaches the use of discrete stilt particles which are not encapsulated. The stilt particles may be composed of glass beads, rounded white silica sand, casein particles and vinyl acetate polymer material particles.

U.S. Pat. No. 3,706,593 to Miyano et al, issued Dec. 13, 1972, is of interest with respect to the protective stilt particles of the present invention. It teaches in FIG. 2 thereof microcapsules comprising a capsular material such as gelatin enclosing certain transparent inorganic particles, for example, glass or silica. There is no teaching of employing these microcapsules as a stilt material in a record sheet.

U.S. Pat. No. 3,179,600 to Brockett does not teach the use of discrete stilt particles. However, it does teach an outer capsule wall containing silica, kaolin or bentonite (note column 3, lines 70–72), which would appear to act as a protective covering against premature rupture of inner capsules containing a marking liquid.

SUMMARY OF THE INVENTION

The present invention relates to a construction for protecting minute, liquid-containing, pressure-rupturable capsule units, coated on a supporting web, from accidental rupture due to pressures such as those encountered in the storage and handling of the coated web. The supporting web may be, and usually is, a sheet of paper. The capsule contents may be chosen from a number of significant materials for pressure release. For example, they may be any of a number of colorless chromogenic materials suitable for causing the appearance of marks on a record sheet when the capsules are ruptured by pressure from a printing member, e.g., a typewriter key, pen, pencil, etc. The construction includes, in a capsule coating for a web, other kaolin particle-containing capsules which are larger than the capsules to be protected, so as to give an interspersion of the two kinds of capsules, which are closely juxtaposed.

The advantage in using the novel construction of the invention, for protecting capsules containing an agent to be preserved against accidental release, is that the surface texture of the coated web is not qualitatively changed by the addition of the physical buffer capsule units. More importantly, when the significant liquid agent is released by the intentional rupture of its enclosing walls, its transfer as a flowing material to the desired place is not impeded by its pressure protector, but rather is aided by the smoothness, the particle size and the non-absorbance of said pressure protector.

THE DRAWING

Both Figures are enlarged and out of proportion views of aspects of the invention showing the conformation of both kinds of units employed in the coating on the support sheet, i.e., the smaller capsules containing a marking liquid and the larger stilt capsules containing kaolin particles.

Figure 1:
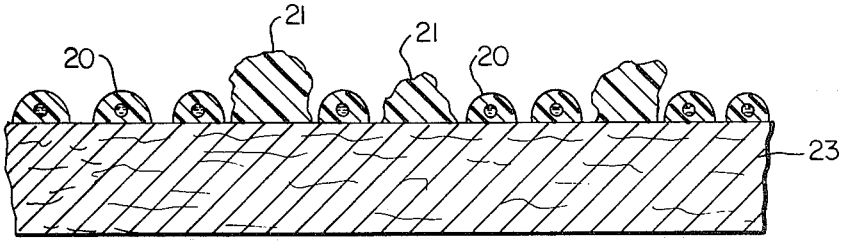
FIG. 1 shows both kinds of units disposed on a support sheet.
Figure 2:
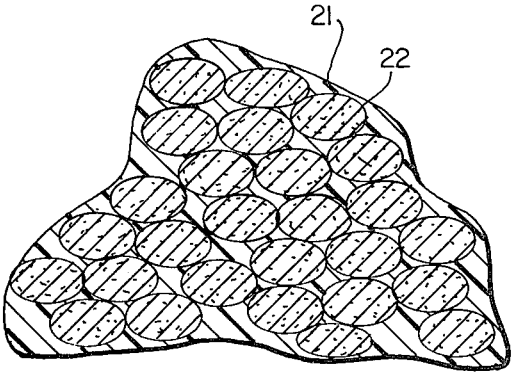
FIG. 2 is a section through a stilt capsule containing kaolin particles in accordance with this invention.

The reference numeral 20 in FIG. 1 designates one of the smaller capsules containing the marking liquid to be protected from accidental release by an adjacent larger stilt capsule 21. FIG. 2 is a section through a larger stilt capsule 21 containing kaolin particles 22. The supporting sheet material 23 (FIG. 1) is shown as a fibrous material, such as paper, although it might well be a film material. The contours of the larger stilt capsules will protect the smaller adjacent capsules containing the marking liquid by overhang or by bridging the accidentally or prematurely applied pressures.

The size of the capsule units depicted in the coating has been exaggerated, relative to the thickness of the supporting web. Generally, if the web is paper, the thickness of the supporting web material, measured in units of mils, is many times the average cross-sectional diameters of the capsule units. The thickness of the supporting web is of minor consequence. The average diameter of the larger stilt capsules shold be about 2 to 12 times greater than the smaller capsules containing the marking liquid. The average cross-sectional size of the smaller, protected capsule units should be in the range of about 3 to 12 microns, usually about 4 to 9 microns, and the larger, protecting capsule units should be in the range of about 20 to 35 microns. The capsules, of both kinds, should be randomly interspersed and in close juxtaposition.

Only that part of the construction which is considered to be novel is shown in FIG. 1, as it is to be understood that solid particulate materials, such as materials reactive toward the encapsulated liquid marking agent, may be coated on the paper and situated under, on top of, or coincidentally with the layer of smaller capsules shown, to make an autogeneous sheet meeding no transfer of material to a second sheet. Alternatively, the coated paper sheet shown may be superimposed with its coated side against a second sheet of paper coated with the necessary reactive materials so that rupture of the marking agent capsules on the first sheet causes the transfer of the liquid agent to the second sheet, where a chemical reaction, such as color development in a colorless chromogenic compound, may take place. There are many such constructions, particularly in the field of record sheet material manufacture. The invention is applicable to other than record systems where pressure is used to bring two liquids together for blending or reaction that are not of significance for marking, but which are to be kept apart until used by application of pressure.

DETAILED DESCRIPTION OF THE INVENTION

As pointed out above, the invention provides a construction using larger kaolin particle-containing capsules to shield closely adjacent smaller liquid-containing capsules that should not be prematurely broken. The protected capsule contents could be any liquid or liquid dispersion which one might wish and be able to encapsulate and coat on a surface of a supporting web. There are many examples of such materials used in commerce and published in the literature. The superiority of this invention is particularly marked in record systems where a back-coated first sheet (CB sheet) comprises small capsules containing a liquid solution of a chemically reactive, colorless, chromogenic material, and the coating of a front-coated underlying second sheet (CF sheet) comprises a solid coreactant designed to convert the colorless, chromogenic material to a distinctively colored product. Such back- and front-coated sheets are also used in multiple sheet record forms as the top and bottom sheets of a stack or manifold assembly, respectively, intermediate sheets of which stack are coated both on the front and on the back to give transfer and copy-receiving properties. The material and economic advantages of using the capsular stilt units of this invention over the use of the previously known capsule coatings in such manifold assemblies is as pronounced as in the case of capsule coated sheets in a two-sheet system. In all of these cases, the transfer efficiency of the system is very important, and is adversely affected if absorbent stilt material in the capsular back coating of the sheets is present. When the absorbent stilt is replaced with kaolin particle-containing capsule buffers as in this invention, the transfer efficiency is enhanced, and more intense marks are developed on the second sheet.

With reference to the capsular wall materials, this invention is not dependent on any particular kind of capsule unit wall material, but only on the relative size and contents of the capsules, except that the large buffering capsules may be overcoated with a harder polymeric material. Minute liquid-containing capsule units of any kind of content in a paper coating may be protected by other larger capsules that contain the kaolin particles.

As the materials forming the walls of the larger kaolin particle-containing capsules, it is ncessary to use a coacervation technique with a water-soluble polymer such as gelatin or albumin in simple coacervation or with gum arabic, carboxymethyl cellulose, sodium alginate, agar-agar or dextran sulfate in complex coacervation. The capsules having such wall materials possess a uniform particle size, and can be produced easily by the methods well known in the prior art such as, for example, disclosed in U.S. Pat. No. 2,800,457 and U.S. Pat. No. Re. 24,899. The walls of the smaller liquid-containing capsules may preferably be polymeric materials formed by an in-situ polymerization or may be produced by coacervation methods as cited above. Examples of patents employing monomers or initial condensates of synthetic resins for forming capsule walls by polymerization methods are U.S. Pat. Nos. 3,755,190 and 4,001,140.

When the protected encapsulated liquid is to be a solution of a dye for use in making marks by a color reaction, it may be of the colorless, chromogenic kind, such as Crystal Violet Lactone, taught by U.S. Pat. No. Re. 23,024, alone or mixed with any of the many colorless chromogenic materials known in the art, of which a large number are noted in U.S. Pat. Nos. 3,525,630; 3,540,909; 3,540,911; 3,558,341; 3,723,141; 3,746,562; 3,940,275 and 4,027,065.

The kaolin particles encapsulated to form the stilt units of the invention are platelike in structure, which is their natural shape, with a uniform size of about 1 to 2 microns. The resulting kaolin-containing capsules comprise encapsulated agglomerates of kaolin which have a uniform shape and a very large size. The weight of stilt capsule units employed is at least 1/5, preferably $\frac{1}{4}$ to $\frac{1}{3}$, of the weight of the liquid marking agent-containing capsule units.

The following Examples are given merely as illustrative of the present invention and are not to be considered as limiting. Unless otherwise noted, the percentages therein and throughout the application are by weight. Measurement of the size of the particles discussed throughout the application is determined by a weight size distribution, i.e., the median size of the weight distribution of the material.

EXAMPLES OF THE INVENTION

Preparation of Stilt Particles

EXAMPLE I

5:1 Ratio of Clay/Gelatin-No Ion Exchange Resin Pre-Treatment Employed

A 68% w/w aqueous slurry (66 g.) of kaolin clay was diluted with 399 g. of distilled water. There was added thereto 90 g. of a 10% solution of 150 Bloom pigskin gelatin and 90 g. of a 10% solution of gum arabic. The pH of the resulting mixture measured 4.6, and was not changed. The mixture was stirred in a bath maintained at 55° C. until it reached bath temperature, and then said mixture was stirred in an ice bath. Added thereto was 2.25 ml. of a 50% solution of glutaraldehyde when the temperature reached 10° C. The mixture was removed from the ice bath, and stirred overnight as it warmed to room temperature. The resulting capsules comprised encapsulated agglomerates of the kaolin clay with a fairly uniform shape of about 31 microns average diameter.

EXAMPLE II

10:1 Ratio of Clay/Gelatin-Ion Exchange Resin Pre-Treatment Employed

A 68% w/w aqueous slurry (132 g.) of kaolin clay was diluted with 378 g. of distilled water. There was added thereto 90 g. of a 10% solution of 150 Bloom pigskin gelatin and 90 g. of a 10% solution of gum arabic. The mixture was stirred in a bath maintained at 55° C. until it reached bath temperature. Thereupon 75 g. of Ionac M-614 ion exchange resin beads (supplied by Ionac Chemical Co. of Birmingham, N.J.) were added, the mixture was stirred for 40 minutes, and the resin beads removed by filtering out with cheesecloth. Ionac M-614 Mixed Ion Exchanger is a chemically equivalent mixture of Ionac C-267 strong acid cation exchange resin, polystyrene/divinylbenzene polymeric spherical beads and Ionac A-542 strong base, Type I anion exchange resin, polystyrene base, spherical beads (in OH-form). Both resins are furnished in the −16+50 mesh size range; NM-60 Mixed Ion Exchanger, furnished by the same source, is also suitable for use in the described procedure. The pH of the filtrate slurry was raised from 4.0 to 4.5 by addition of 3 drops of a 20% NaOH solution. It was then stirred in an ice bath, and 2.25 ml. of a 50% solution of glutaraldehyde was added. The encapsulated clay comprises agglomerates having an average diameter of about 32 microns.

EXAMPLE III

10:1 Ratio of Clay/Gelatin-No Ion Exchange Resin Pre-Treatment Employed

A 68% w/w aqueous slurry (132 g.) of kaolin clay was diluted with 378 g. of distilled water. There was added thereto 90 g. of a 10% solution of 150 Bloom pigskin gelatin and 90 g. of a 10% solution of gum arabic. The pH of the resulting mixture measured 4.75, and was lowered to 4.5 with 3 drops of 10% $H_2SO_4$ solution. The mixture was transferred to an ice bath, and stirred therein. A 50% solution of glutaraldehyde (2.25 ml.) was added when the temperature reached 10° C. The mixture was removed from the ice bath, and stirred overnight as it warmed to room temperature. The clay was mostly unagglomerated, except for a few irregular chunks in the 100 micron range.

The preceding Examples illustrate that the phase ratio of dry clay to dry wall material can be increased by the use of an ion exchange resin pre-treatment. As noted in these Examples, when the phase ratio of clay to gelatin is 10:1, successful agglomeration for the objectives of this invention did not occur (Example III). However, this same ratio of clay to gelatin provided successful agglomeration and therefore acceptable stilt capsules when the ion exchange resin pre-treatment was employed (Example II). At a phase ratio of 5:1 of clay to gelatin, acceptable stilt capsules are obtained even without such a pretreatment (Example I).

Preparation of Liquid Marking Agent Capsules

EXAMPLE IV

An aqueous emulsion having liquid marking agent droplets of about 5 microns diameter was prepared by the following procedure:

To 5000 parts of a 7% solution of EMA-31 [poly-(ethylene-comaleic anhydride), sold by Monsanto Co., St. Louis, Missouri]in water at 50° C. were added 352 parts of urea and 35 parts of resorcinol. The resulting solution was cooled to 25° C. and the pH adjusted to 3.5 with a 20% aqueous sodium hydroxide solution. The solution was diluted with 5574 parts of water and into this diluted polymer solution was emulsified 6555 parts of an oily ink formulation comprising 1.7% of 3,3-bis(4-dimethylaminophenyl)-6-dimethylamino phthalide, 0.55% of 2-anilino-3-methyl-6-diethylamino fluoran and 0.55% of 3,3-bis(1-ethyl-2-methylindol-3-yl) phthalide in a mixture of solvents including a benzylated ethyl benzene and a relatively high-boiling hydrocarbon oil, such as one having a distillation range of 400°-500° F. When the oil droplet size was reduced to an average diameter of about 5 microns, the high speed agitation was suspended, circulation agitation commenced and 881 parts of 37% formaldehyde were added. The batch was then heated to 55° C., held at that temperature for 6 hours and the heating then discontinued. The pH of the batch wa adjusted to 7.5 with a 28% aqueous ammonium hydroxide solution 24 hours after heating of the batch had been discontinued.

The now-completed capsule units thus prepared may be used either with or without isolation from the vehicle.

Preparation of Capsule-Coated Record Paper

EXAMPLE V

Capsule-coated paper was produced by mixing the product of Examples II and IV to form a composition. The aqueous suspension of stilt capsule units prepared in Example II was used without recovery of the capsule units from the manfacturing vehicle. Similarly, the dye-bearing aqueous suspension of capsules of Example IV was used without isolation from the manufacturing vehicle. The combination coating slurry was prepared by mixing capsule slurry IV, capsule slurry II, an aqueous solution of Stayco S binder starch (an oxidized corn starch manufactured by A.E. Staley, Decatur, Illinois) and water sufficient to produce a 17% solids content dispersion. The following is the composition of the resulting dispersion on a relative dry parts basis:

| | Parts dry |
|---|---|
| Marking liquid capsules (Ex. IV) | 100 |
| Stilt capsules (Ex. II) | 30 |
| Binder starch | 9 |

The dispersion was coated on a 34 lb. (3300 $ft^2$) base stock with a wire wound coating rod and dried to yield a marking liquid capsule coat weight of 2.5 lbs./3300 $ft^2$.

The dried coating of Example V consisted of interspersed capsules of stilt units containing kaolin particles and capsules containing the liquid marking agent, the kaolin particle-containing capsules being sufficiently larger than those containing marking material to act as physical stilts to protect the latter.

EXAMPLE VI

Capsule-coated paper was prepared in the same manner as described in Example V, except that the stilt particles of Example I were mixed with the marking liquid capsules of Example IV and the marking liquid capsule coat weight was 2.6 lbs./3300 $ft^2$.

EXAMPLE VII

For comparative purposes a capsule-coated paper was made using an uncooked starch particle stilt as described in British Pat. No. 1,252,858.

Capsule-coated paper was produced by mixing the capsule slurry of Example IV, uncooked wheat starch particles and cooked binder starch. The following is the composition of the resulting dispersion made at 17% solids content, on a relative dry parts basis:

| | Parts Dry |
|---|---|
| Marking liquid capsules (Ex. IV) | 100 |
| Uncooked wheat starch particles | 30 |
| Binder starch | 9 |

The dispersion was coated and dried as in Example V.

The capsule-coated papers (CB) of Examples V, VI, VII were tested face to face with an underlying receiving sheet (CF) bearing a coating comprising an oil-soluble metal salt of a phenol-formaldehyde novolak resin made by procedures described in U.S. Pat. Nos. 3,732,120 and 3,455,721. Four different tests were performed on the above CB-CF combinations. The first two of these tests, measures of responses of carbonless paper to deliberate marking pressures, are the typewriter intensity (TI) test and the calender intensity (CI) test. In the TI test a standard pattern is typed on a CB-CF pair. The reflectance of the printed area is a measure of color development on the CF sheet and is reported as the ratio of the reflectance of the printed area to that of the untyped area ($I/I_o$) and is expressed as a percentage.

A CI test is essentially a rolling pressure test as opposed to the impact pressure of the TI test and is conducted to determine the amount of color developed from the transfer of marking liquid obtained by such rolling pressure. Again, the results are reported as the ratio of the reflectance of the marks produced on the CF sheet as compared to the background reflectance of the paper ($I/I_o$) expressed as a percentage. In both the TI and CI test results the lower the value, the more intense the mark and the better the system as to visibility.

The last of two of the four tests utilized for examples V, VI and VII are measures of responses of carbonless papers to accidental or casual marking pressures. These two tests are the frictional smudge (FS) test and the static smudge (SS) test. In the FS test a CF sheet is placed coated sides together against a CB sheet with a 9 lb. load applied over a $1\frac{1}{8}$ inches $\times 2\frac{1}{8}$ inches rectangular area. While this load is applied, the CB sheet is pulled $11\frac{1}{2}$ inches relative to the stationary CF sheet. The smudge area reflectance and the background reflectance are measured.

A static smudge (SS) test is performed by appling a 300 pound per square inch hydraulic gauge pressure through a rubber diaphragm to a CB-CF pair over a circular area $1\frac{1}{4}$ inches in diameter. This static load is held on the CB-CF pair for 30 seconds. The smudge area reflectance and the background reflectance are measured.

Both the FS and the SS results are reported as the ratio of the reflectance values of the smudged area and the background ($I/I_o$) and are expressed as a percentage. A value of 100 for smudge intensity represents no smudge color at all and the lower the value the less is the smudge protection. A value of about 80 or greater is usually acceptable for FS and a value of about 88 or greater is usually acceptable for SS.

The following results were obtained when CB examples V, VI and VII were tested with a CF sheet bearing a coating comprising an oil-soluble metal salt of a phenolic resin:

| CB | TI | CI | FS | SS |
|---|---|---|---|---|
| Ex. V | 48 | 48 | 87 | 88 |
| Ex. VI | 45 | 47 | 89 | 89 |
| Ex. VII | 51 | 56 | 90 | 91 |

The above data indicates that the record sheet of the present invention (Examples V and VI) produces fully acceptable smudge protection and calender and typewriter intensities superior to conventional stilt systems.

The stilt capsules of the invention, consisting essentially of a plurality of kaolin particles held in a matrix of deposited coacervated material, should be about 2 to 12 times greater in average diameter or size than the pressure-rupturable capsules to be protected against premature release of their contents. Generally, as noted above, the stilt capsules have a size in the range of about 20 to 35 microns, while the liquid-containing, pressure-rupturable capsules, which usually have a substantially spherical outer conformation, have an average cross-sectional size of about 3 to 12 microns.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A pressure-sensitive record material which comprises a substrate, and a coating on at least one surface of the substrate comprising minute pressure-rupturable capsules containing a liquid solution of colorless chromogenic material and non-pressure-rupturable capsules containing a plurality of agglomerated kaolin particles, the kaolin-containing capsules being produced by coacervation of a water-soluble polymer and being present in an amount of at least 1/5 of the weight of the liquid-containing capsules, said kaolin-containing capsules having an average diameter of about 2 to 12 times greater than the liquid-containing capsules and being substantially uniformly sized and randomly interspersed in the coating with the liquid-containing capsules.

2. The pressure-sensitive record material of claim 1, wherein the substrate is a paper sheet.

3. The pressure-sensitive record material of claim 1, wherein said water-soluble polymer is gelatin.

4. The pressure-sensitive record material of claim 1, wherein the wall material of the liquid-containing capsules comprises polymeric materials formed by in situ polymerization and the wall material of the stilt capsules comprises a complex coacervate of water-soluble polymers.

5. The pressure-sensitive record material of claim 4, wherein the wall material of the stilt capsules comprises a complex coacervate of gelatin and gum arabic.

6. The pressure-sensitive record material of claim 1, wherein the weight of stilt capsules in said coating is about 1/5 to $\frac{1}{3}$ of the weight of the liquid-containing capsules therein.

7. The pressure-sensitive record material of claim 1, wherein the average cross-sectional size of the pressure-rupturable capsules is from about 3 to 12 microns and the average cross-sectional size of the non-pressure-rupturable capsules is from about 20 to 35 microns.

8. A pressure-sensitive record material comprising a substrate having a coating thereon of an interspersed mixture of minute capsules in close juxtaposition comprising substantially spherical, pressure-rupturable capsules containing liquid droplets of colorless chromogenic marking material and non-pressure-rupturable capsules consisting essentially of a plurality of agglomerated kaolin particles held in a matrix of deposited coacervated water-soluble polymer and having an average diameter of 2 to 12 times greater than the pressure-rupturable capsules, the amount of kaolin-containing capsules present in the record material being at least 1/5 the weight of the pressure-rupturable capsules.

9. The pressure-sensitive record material of claim 8, wherein the substrate is a paper sheet.

10. The pressure-sensitive record material of claim 8, wherein said water-soluble polymer is gelatin.

11. The pressure-sensitive record material of claim 8, wherein the wall material of said pressure-rupturable capsules comprises polymeric materials formed by in situ polymerization and the wall material of said non-pressure-rupturable capsules comprises a complex coacervate of water-soluble polyers.

12. The pressure-sensitive record material of claim 11, wherein the wall material of said non-pressure-rupturable capsules comprises a complex coacervate of gelatin and gum arabic.

13. The pressure-sensitive record material of claim 8, further including a material capable of producing a colored mark upon contact with said liquid droplets of marking material upon rupture of said pressure-rupturable capsules.

14. The pressure-sensitive record material of claim 13, wherein the material capable of producing a colored mark upon contact with said liquid droplets of marking material is an oil-soluble metal salt of a phenol-formaldehyde novolak resin.

15. A pressure-sensitive record material which comprises a first substrate coated with an interspersed mixture of minute capsules in close juxtaposition comprising substantially spherical, pressure-rupturable capsules containing liquid droplets of colorless chromogenic marking material, and non-pressure-rupturable capsules consisting essentially of a plurality of agglomerated kaolin particles held in a matrix of deposited coacervated material and having an average diameter of about 2 to 12 times greater than the liquid-containing capsules, the amount of kaolin-containing capsules present in the record material being at least 1/5 the weight of the pressure-rupturable capsules, and, in contiguous relationship with said first substrate, a second substrate having a coating of a material capable of producing a colored mark upon contact with said liquid droplets of marking material upon rupture of said pressure-rupturable capsules.

16. The pressure-sensitive record material of claim 15, wherein the first and second substrates are paper sheets.

17. The pressure-sensitive record material of claim 15, wherein the material capable of producing a colored mark upon contact with said liquid droplets of marking material is an oil-soluble metal salt of a phenol-formaldehyde novolak resin.

18. A manifold assembly comprising a plurality of coated first and second substrates as defined in claim 15.

19. The pressure-sensitive record material of claim 15, wherein the average cross-sectional size of the pressure-rupturable capsules is from about 3 to 12 microns and the average cross-sectional size of the non-pressure-rupturable capsules is from about 20 to 35 microns.

* * * * *